US009872111B2

(12) United States Patent
Elian et al.

(10) Patent No.: US 9,872,111 B2
(45) Date of Patent: Jan. 16, 2018

(54) ACOUSTIC SENSOR PACKAGE

(71) Applicant: Infineon Technologies Austria AG, Villach (AT)

(72) Inventors: Klaus Elian, Alteglofsheim (DE); Thomas Mueller, Lappersdorf (DE)

(73) Assignee: Infineon Technologies Austria AG, Villach (AT)

( * ) Notice: Subject to any disclaimer, the term of this patent is extended or adjusted under 35 U.S.C. 154(b) by 0 days.

(21) Appl. No.: 13/786,559

(22) Filed: Mar. 6, 2013

(65) Prior Publication Data

US 2014/0254850 A1 Sep. 11, 2014

(51) Int. Cl.

| | |
|---|---|
| ***H04R 17/02*** | (2006.01) |
| *H04R 31/00* | (2006.01) |
| *H04R 3/00* | (2006.01) |

(52) U.S. Cl.

CPC ..... *H04R 17/025* (2013.01); *H04R 3/005* (2013.01); *H04R 31/00* (2013.01); *H04R 2420/07* (2013.01); *H04R 2499/13* (2013.01); *Y10T 29/49005* (2015.01)

(58) Field of Classification Search

USPC ..... 381/175, 355

See application file for complete search history.

(56) References Cited

U.S. PATENT DOCUMENTS

| | | | | |
|---|---|---|---|---|
| 4,597,099 | A * | 6/1986 | Sawafuji | H04R 17/00 310/313 D |
| 5,510,765 | A * | 4/1996 | Madau | B60R 25/1004 340/429 |
| 5,804,906 | A * | 9/1998 | Tsutsumi | H04R 17/00 310/322 |
| 7,331,212 | B2 * | 2/2008 | Manlove | G01D 11/245 73/12.01 |
| 2006/0291687 | A1 * | 12/2006 | Maekawa | H04R 1/2842 381/389 |
| 2007/0157699 | A1 * | 7/2007 | Manlove | G01P 1/023 73/12.01 |
| 2012/0181639 | A1 * | 7/2012 | Ehrenpfordt | B81B 7/0061 257/416 |

* cited by examiner

*Primary Examiner* — Amir Etesam
(74) *Attorney, Agent, or Firm* — Slater Matsil, LLP

(57) ABSTRACT

Representative implementations of devices and techniques provide an improved signal receive time to a sensor component. The sensor component is enclosed within a package arranged to allow the sensor to potentially receive a signal in less time. The package may have a cavity, and the cavity may be at least partly filled with an acoustical transducer.

23 Claims, 8 Drawing Sheets

A)

B)

A)

B)

A)

B)

ACOUSTIC SENSOR PACKAGE

BACKGROUND

Many modern applications use sensor devices to collect data or relay information relating to the various applications. Sensor devices, for example, may relay information regarding a potential impact condition associated with a portion of an automobile, or the like. For example, a sensor may receive a signal indicating that the portion of the vehicle has collided with an object, an indication that a safety or restraint device (such as an air bag, for example) is to deploy.

In the case of vehicle crash sensors, many types of sensors may be used for different impact types and similar scenarios. For example, acceleration sensors may be used to detect sudden changes in the acceleration of the vehicle, pressure sensors may be used to detect changes in pressure or shock waves due to an impact, gravity sensors may be used to detect changes in the vehicle's attitude with respect to gravity (e.g., pitch, roll, etc.). Further, acoustic sensors may be used to detect the sounds of a collision with the vehicle.

When using any of the above sensors or others in a vehicle crash-detection application, or the like, the design of the system generally includes the response time of the sensor(s) within the system. For example, the use of various types of sensors may contribute to different latencies related to the occurrence of the event (i.e., collision, etc.) and the resulting deployment of the restraint device. Additionally, different installation techniques used on multiple like sensors may also contribute to the latencies of responses.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure.

DETAILED DESCRIPTION

Overview

Figure 1:
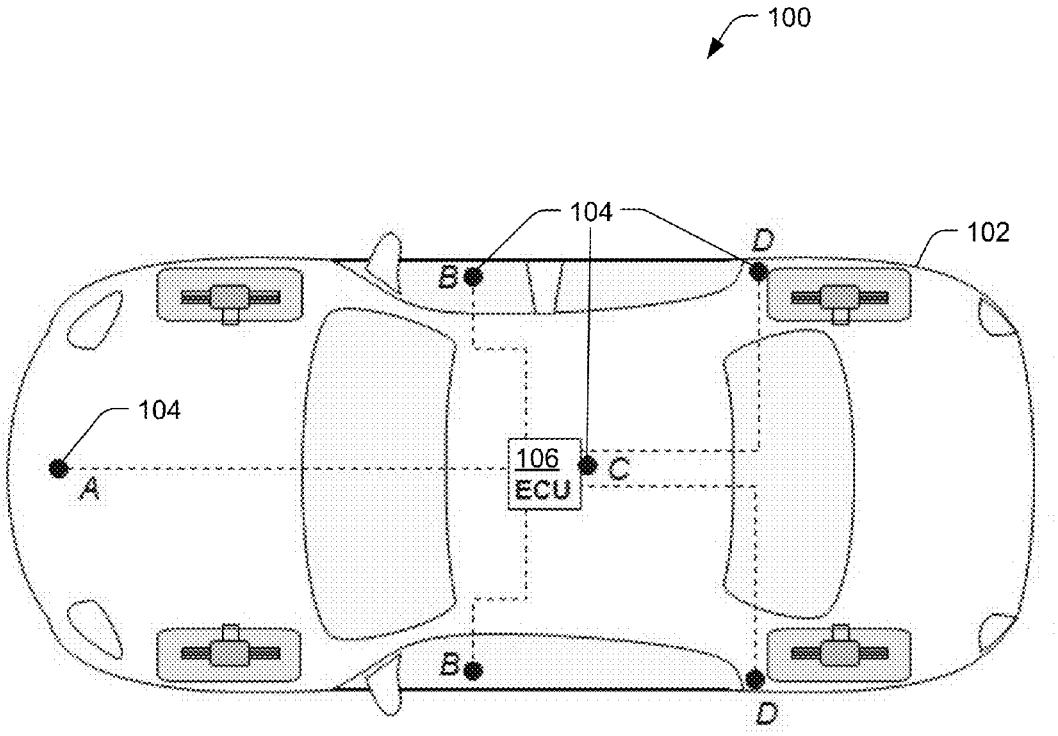
FIG. 1 is a diagram of an example environment, wherein the devices and techniques disclosed herein may be applied, according to an implementation.

In many sensor applications, such as in crash-detection applications, for example, it is desirable to optimize the response time of the applications' systems. For example, it may be desirable to have an air bag deploy as quickly as possible following the occurrence of a collision of a vehicle. The speed of deployment may make the difference in the protection provided, in some cases. Further, a quicker response time may be desirable for a side-impact than for a front-impact, for example, based on the relative sizes of the deformable zones in each case.

In various implementations, the response time of such a system can be improved by reducing the time that a sensor receives an indication of an event following the occurrence of the event. In one example, the time for a sensor to receive an indication that a vehicle has had a collision can be reduced based on acoustical transfer mechanisms and techniques. Representative implementations of devices and techniques provide an improved signal receive time to a sensor component. In various implementations, the sensor component is enclosed within a package arranged to allow the sensor to receive a signal in less time.

For example, in an implementation, the package may have a cavity, and the cavity may enclose the sensor and be at least partly filled with a transducer medium or contain a transducer component. In some implementations, the package may be sealed or covered to protect the sensor and/or the transducer medium/component. In an implementation, the package may be enclosed within a protective shell to protect the sensor and the package from the environment.

In various implementations, the package may be mounted to a rigid surface, in such a way as to optimize the speed of signal reception. For example, the package may be mounted to a vehicle body, for instance, with an opening of the package (e.g., opening of the cavity) facing the rigid surface. In an implementation, a membrane covering the opening of the package is placed parallel to and in contact with the rigid surface, such that acoustical waveforms are transmitted from the rigid surface to the membrane and to the acoustic sensor, via any transducing media surrounding the sensor.

In some implementations, multiple electrical components may be mounted within the package, along with the sensor component. In one example, a controller may be enclosed within the package and coupled to the sensor component. For example, the controller may analyze a signal output by the sensor, and output a signal indicating a predefined state (e.g., a collision has occurred) based on the analysis. This may distinguish between an actual event (e.g., a collision) from a false indication (e.g., a ball striking the vehicle, etc.), or the like.

Various implementations and arrangements are discussed with reference to electrical and electronics components and various carriers. While specific sensor components (i.e., acoustic sensors) are mentioned, this is not intended to be limiting, and is for ease of discussion and illustrative convenience. The techniques and devices discussed with reference to a sensor housing or package are applicable to any type or number of sensor components (e.g., acoustic, pressure, acceleration, etc.), as well as accompanying circuits (e.g., integrated circuits, analog circuits, digital circuits, mixed circuits, controllers, processors, etc.), groups of components, packaged components, structures, and the like, that may be mounted within a housing or like package. For ease of discussion, the generic terms "sensor" and "controller," respectively, are used herein to describe any of the above.

Further, the techniques and devices discussed with reference to a printed circuit board are applicable to any type of carrier (e.g., board, chip, wafer, substrate, printed circuit board (PCB), bus, flexible printed carrier, printed circuit tape, etc.) that the sensor and/or the controller may be mounted to. For ease of discussion, the generic term "carrier" is used herein.

Implementations are explained in more detail below using a plurality of examples. Although various implementations and examples are discussed here and below, further implementations and examples may be possible by combining the features and elements of individual implementations and examples.

Example Environment

FIG. 1 is a diagram of an example environment 100, wherein the devices and techniques disclosed herein may be applied, according to an implementation. The environment 100 is generically described and illustrated in terms of a vehicle 102. It is to be understood that the techniques and/or devices described may be implemented as part of a vehicle 102, as an accessory to the vehicle 102, or as part of another system (for example as a remote system to the vehicle 102, etc.). Further, portions of devices and/or techniques may be integrated with the vehicle 102 while other portions are remotely located.

The vehicle 102 of FIG. 1 and of the disclosure is illustrated and discussed in generic terms and often described in terms of an automobile. This is, however, for ease of discussion. The techniques and devices described herein with respect to sensor systems is not so limited, and may be applied to other types of vehicles (e.g., farming equipment, excavation equipment, construction equipment, military vehicles, recreational vehicles, etc.), as well as to industrial or commercial processes or equipment (e.g., sensor systems on production lines, etc.), and the like, without departing from the scope of the disclosure. Further, while the illustrated vehicle 102 is shown as a simple vehicle having four wheels, the techniques and devices described herein are intended for implementation with vehicles having single or multiple axles, any number of wheels, tracks, skids, and so forth. Vehicles for overland travel are intended embodiments, as well as amphibious vehicles, boats, ships, and other watercraft, aircraft, and other air and/or space vehicles, trains and other rail vehicles, and the like.

As shown in the illustration of FIG. 1, a vehicle 102 (or other system, as described above) may be fitted with any number of sensors 104. In various implementations, the sensors 104 may be disposed in various locations (A, B, C, D, etc.) in, on, or throughout the vehicle 102. In some implementations, the type of sensor used at a location (A, B, C, D, etc.) may be based on the intended information to be collected or relayed at the particular location (A, B, C, D, etc.).

As shown in FIG. 1, the sensors 104 may be positioned to sense an impact or collision involving the vehicle 102. In various implementations, the sensors 104 may be positioned to sense other events (pitch, roll, acceleration, etc.), and the like. For the purposes of this disclosure, sensors 104 are described as acoustic sensors positioned to detect acoustic waveforms; however, all other scenarios regarding different types of sensors for various purposes are intended to be included within the scope of the disclosure.

In an implementation, as shown in FIG. 1, one or more sensors 104 may be applied with an electronic control unit (ECU) 106, or like control or computing device. The sensors 104 may be communicatively coupled to the ECU 106, relaying detected information to the ECU 106. In various implementations, the ECU 106 may control deployment of safety or restraint systems, for example, based on information received from the sensors 104.

As discussed above, the techniques, components, and devices described herein are not limited to the illustration in FIG. 1, and may be applied to other system and device designs and/or applications without departing from the scope of the disclosure. In some cases, additional or alternative components may be used to implement the techniques described herein.

Example Sensor Arrangement

Figure 2:
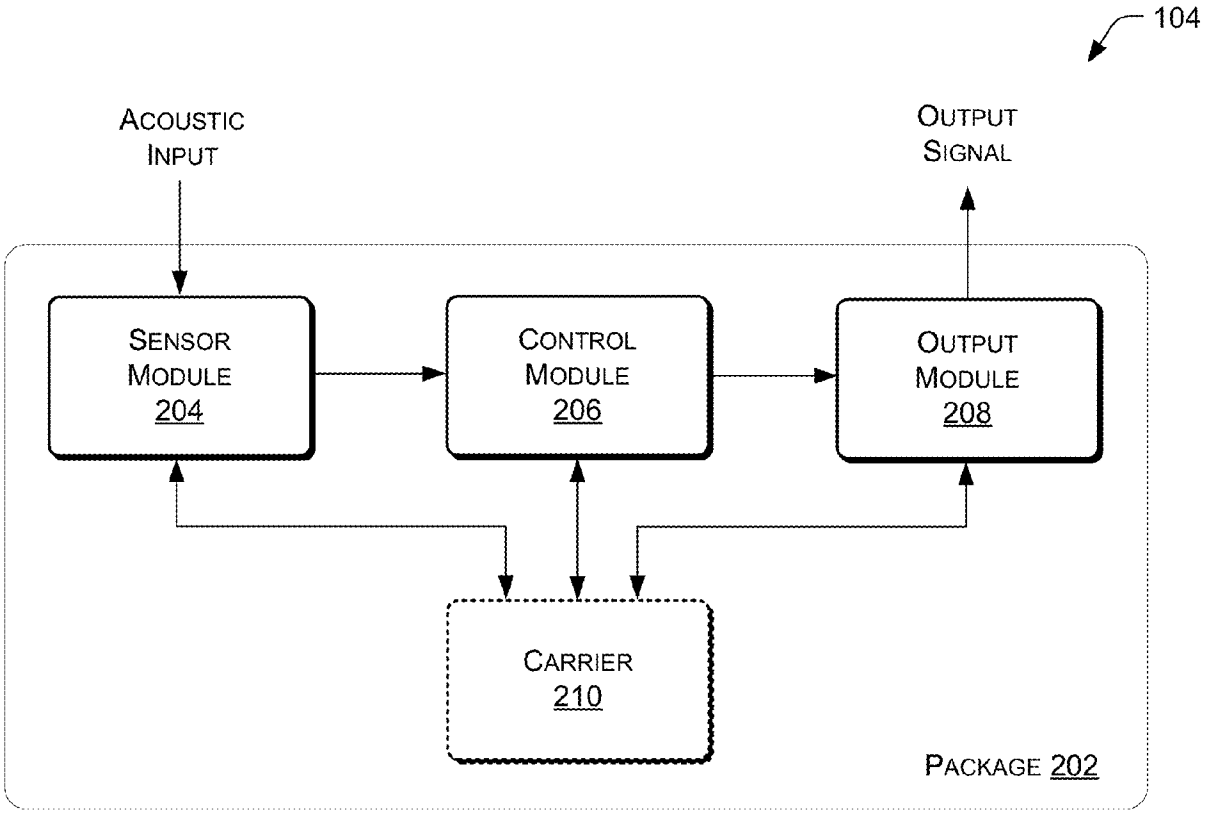
FIG. 2 is a block diagram of an example sensor arrangement, enclosed within a housing, according to an implementation.
Figure 3:
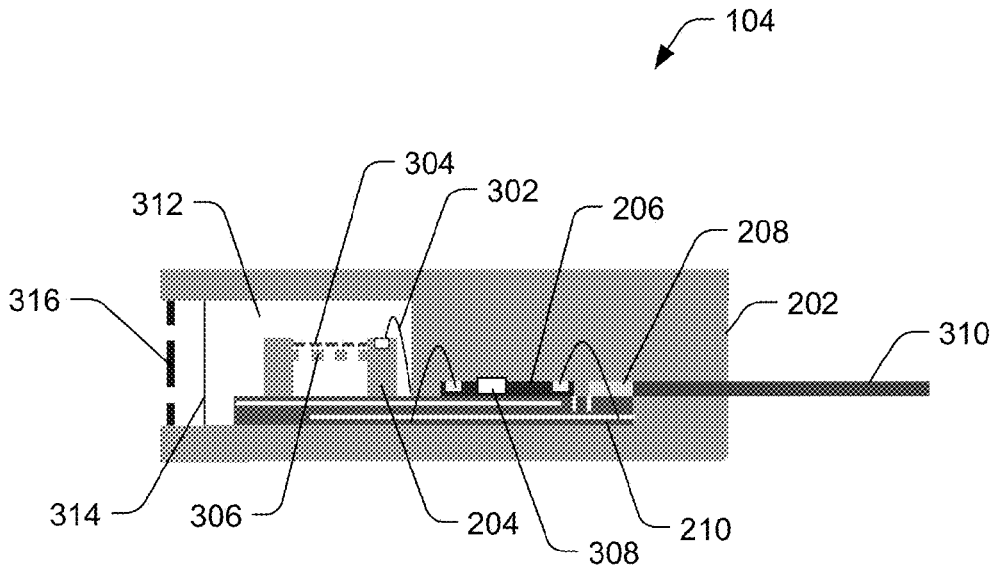
FIG. 3 is a cross-sectional profile view of an example housing, including an enclosed sensor arrangement, according to an implementation.

FIG. 2 is a block diagram of an example sensor arrangement ("sensor") 104, shown enclosed within a package 202 (e.g., housing, enclosure, etc.), according to an implementation. FIG. 3 is a cross-sectional profile view of the example sensor 104, including the package 202, according to the implementation. As shown in FIGS. 2 and 3, an example sensor 104 may include a sensor module 204, a control module 206, an output module 208, and an optional carrier 210. In alternate implementations, fewer, additional, or alternate components may be included in a sensor 104.

In various implementations, a sensor module 204 comprises a sensor device, as described above. For example, in one implementation, the sensor module 204 comprises an acoustic sensor device, such as a microphone, or the like. In an implementation, the sensor module 204 is arranged to receive an acoustic waveform and to output a signal based on the waveform. For example, in the event of an impact with the vehicle 102, the sensor module 204 may be arranged to receive the acoustic waveform of the impact and to output a signal on an output conductor (e.g., conductor 302) based on the waveform received.

In some implementations, the sensor module 204 is a surface mount device, such as a miniature surface mount microphone. For example, the microphone may be mounted or formed on a chip, or a chip-based device. In other implementations, the sensor module 204 comprises other types or designs of sensors.

In alternate implementations, the sensor module 204 may include associated components, such as connectivity elements and/or protection elements. For example, as shown in FIG. 3, the sensor module 204 may include conductors 302 arranged to provide connectivity and/or communication with other portions of the sensor 104. Further, the sensor module 204 may include a protective grid or membrane 304, for example, to protect portions of the sensor module 204, such as a diaphragm, a piezoelectric element, or the like (306).

If included, the control module 206 may be enclosed within the package 202, and coupled to the sensor module 204. In an implementation, the control module 206 is arranged to receive the signal output from the sensor module 204 and to output a state signal indicating one of a plurality of predefined states, based on the signal output from the sensor module 204. In one example implementation, the control module 206 is arranged to analyze an output of an acoustic sensor (i.e., the sensor module 204) and to output a signal indicating the predefined state based on the analysis. In some implementations, various predefined states may include: non-event, event, and possible event. In other implementations, fewer, additional, or alternate states may be predefined.

For instance, the analysis by the control module 206 may determine whether the output signal from the sensor module 204 indicates an event (e.g., a collision, etc.) that indicates a safety device (e.g., an air bag, etc.) is to be deployed, or indicates a non-event, e.g., something else that does not require deployment of a safety device (such as a ball hitting the vehicle, etc.). In this way, false deployments and their associated costs and inconvenience can be avoided. In the implementation, the control module 206 is able to differentiate between various acoustic vibrations based on the properties of the vibrations (e.g., frequency and wavelength, duration, magnitude, characteristic wave shape, etc.) to determine whether an event is indicated, meaning deployment of a safety device is indicated.

In an implementation, the control module 206 of the sensor 104 outputs the signal indicating the predefined state, and another system such as the ECU 106 receives the signal and deploys the safety or restraint device(s) in response to receiving the signal. In an alternate implementation, the acoustic signal received by a single sensor module 204 may not be definitive. Then, the control module 206 may output a "possible event" signal. If the control module outputs a "possible event" signal, the ECU 106, or the like, may aggregate signals from multiple sensors 104 to determine whether to deploy the safety device. In an implementation, the ECU 106, or the like, may have rules in place to determine whether to deploy a safety device, based on aggregated results from a plurality of sensors 104.

In another alternate implementation, the predefined states output by the control module 206 may comprise analog or digital voltage levels, digital or binary codes, or the like. The ECU 106, or the like, may be prearranged (e.g., programmed, etc.) to determine whether deployment of a safety device is indicated, based on values of the predefined states.

In an implementation, the control module 204 may comprise a controller, such as a microcontroller, a microprocessor, a logic circuit, or the like. For example, in an implementation, the control module 204 comprises a programmable application-specific integrated circuit (ASIC), or the like. In other implementations, the control module 206 may comprise a programmed general purpose processor, or similar device.

Various portions of the sensor 104, including portions of the control module 206, output module 208 (including protocols, etc.), as well as other components, if present, can be implemented as a system, method, apparatus, or article of manufacture, using standard programming and/or engineering techniques to produce software, firmware, hardware or any combination thereof to control a computer or processor to implement the disclosure. For example, the sensor 104 may include a memory storage device 308 coupled to the control module 206 and including data stored thereon, such as calibration data, reference data, controller-executable instructions, and the like. In one implementation, the memory storage device 308 is integral to the control module 206. In an alternate implementation, the memory storage device 308 may be remotely located elsewhere in the package 202, the vehicle 102, or remote to the vehicle 102 (e.g., cloud storage, etc.).

In such implementations, a sensor arrangement for a safety device deployment system, for example, may be implemented using one or more forms of computer-readable media (which may be included as system memory, for example, with the control module 206) that is accessible by the control module 206, the ECU 106, or the like. Computer-readable media may include, for example, computer storage media and communications media.

Computer-readable storage media includes volatile and nonvolatile, removable and non-removable media implemented in any method or technology for storage of information such as computer-readable instructions, data structures, program modules or other data. Memory 308 is an example of computer-readable storage media. Additional types of computer-readable storage media that may be present include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may accessed by the control module 206, the ECU 106, or the like.

In contrast, communication media typically embodies computer readable instructions, data structures, program modules, or other data in a modulated data signal, such as a carrier wave, or other transport mechanism.

If included, the output module 208 may be arranged to transmit the state signal output by the control module 206. For example, the output module 208 may be arranged to output the state signal via a conductor 310, as shown in FIG. 3. In an example, the conductor 310 may be coupled to the PCB 210 and/or the output module 208 and passed through an opening in the package 202 for connection to the ECU 106, or the like. In an alternate implementation, the output module 208 may be arranged to output the state signal wirelessly via one or more wireless technologies (e.g., Bluetooth™, radio frequency (RF), WiFi™, or the like). For example, the output module 208 may include a wireless transmitter, or similar system or device. In various implementations, the output module 208 may use one or more communication protocols to transmit the state signal either by hard-wire, optically, or wirelessly.

In some implementations, the sensor 104 may include one or more carriers 210, enclosed within the housing 202 and arranged to provide one or more signal paths for the sensor module 204, the control module 206, the output module 208, and/or the memory storage device 308. In an implementation, at least the sensor module 204 and/or the control module 206 are mounted to and/or coupled to the carrier 210. In alternate implementations, additional components may be mounted to and/or coupled to the carrier 210. In such alternate implementations, the carrier 210 may provide signal paths for the additional components.

In various implementations, the carrier 210 comprises a bus, a flexible bus, a printed circuit board (PCB), a flexible PCB, flexible circuit tape, or the like. In one implementation, multiple carriers 210 are included within the sensor package 202.

In one implementation, the package 202 is a rigid housing, offering protection from outside elements and forces to the sensor module 204 (and other components) mounted within the package 202. For example, in an implementation, the package and components comprise a System-in-Package (SiP). In some implementations, the package 202 is arranged to enclose multiple electrical components (e.g., multiple devices, circuits, etc.).

The sensor package 202 is shown in FIG. 3 in cross-section to reveal some detail of the enclosed components within the package 202. In an implementation, the sensor package 202 is a molded package enclosing at least the sensor module 204 and the control module 206. In alternate implementations, the package encloses additional components, such as the memory storage device 308, the output module 208 and the carrier 210, as shown in FIG. 3. In various implementations, the housing (i.e., package 202) is molded, at least in part, to one or more of the sensor module 204, the control module 206, and the carrier 210.

In an implementation, as shown in FIG. 3, the package is integral to the sensor module 204 and the control module 206. For example, in the implementation, the package 202 provides the physical foundational structure for the sensor module 204 and the control module 206, whether there is a carrier 210 present or not. In such an implementation, the package 202 is molded around some or all of the contours of the sensor module 204 and/or the control module 206, as well as other modules or components if applicable. Accordingly, in some implementations, the package 202 encapsulates some of the components enclosed within the package 202. For example, in some implementations, the package 202 may be substantially solid after it is formed, partly or fully surrounding some components or items within the package 202.

In an alternate implementation, the package 202 comprises a pre-molded casing. In various implementations, the casing may be a single molded element, or may be comprised of multiple molded elements coupled together, for example. In one implementation, the package 202 includes one or more electrical contacts molded into the casing and extending to couple the components within the package 202 to each other or to the carrier 210, for example.

In various implementations, the sensor 104, including the sensor module 204, the control module 206, and the housing (i.e., package) 202, may be employed as a module or system. In alternate implementations, the system may include other components, such as the output module 208, one or more carriers 210, and the like.

In an implementation, as shown in FIG. 3, the package 202 includes a cavity 312 surrounding at least the sensor module 204. In such an implementation, some or all of the remaining components (e.g., the control module 206, the output module 208, the carrier 210, the memory storage device 306, etc.) if present, may be either partially or fully encased by the package 202 material. In one implementation, most or all of the components enclosed within the package 202 are within the cavity 312.

In an implementation, the cavity 312 is a sealed cavity 312 surrounding at least the microphone (i.e., sensor module 204). In the implementation, the sealed cavity 312 is at least partly filled with an acoustical transducing media. For example, the acoustical transducing media may include one or more of a gas, a liquid, and a solid medium, or a combination of the same, that are arranged to conduct acoustic waveforms. In such an implementation, an acoustic waveform may be conducted or transported from the source of the waveform to the package 202, from the package 202 to the acoustic media within the cavity 312, and from the acoustic media within the cavity 312 to the sensor module 204.

In various implementations, different types of acoustical transducing media may be used to achieve different results. In general, the different types of acoustical transducing media conduct acoustic waveforms at different rates. For example, the speed of an acoustic signal in air is about 0.3 m/ms, in oil it is about 1.3 m/ms, in water it is about 1.5 m/ms, and in iron it is about 5 m/ms. Accordingly, one or more of the media may be selected based on the speed of acoustic signals through the media, among other considerations.

In an implementation, the sensor 104 includes a protective membrane 314 overlaying an opening of the package 202. For example, the protective membrane 314 may be an acoustically transparent membrane, or the like. In the implementation, the membrane 314 is arranged to seal the opening of the package 202 and to allow acoustic waveforms to pass into the cavity 312 to the acoustic sensor (i.e., sensor module 204). In an example implementation, the cavity 312 is sealed using the membrane 314 to prevent acoustical transducing media from escaping the cavity 312.

In another implementation, the sensor 104 includes a protective screen 316 overlaying an opening of the package 202. In the implementation, the screen 316 is arranged to prevent particles, or the like, from entering the cavity 312, or damaging the membrane 314, if present.

Example Implementations

Figure 4:
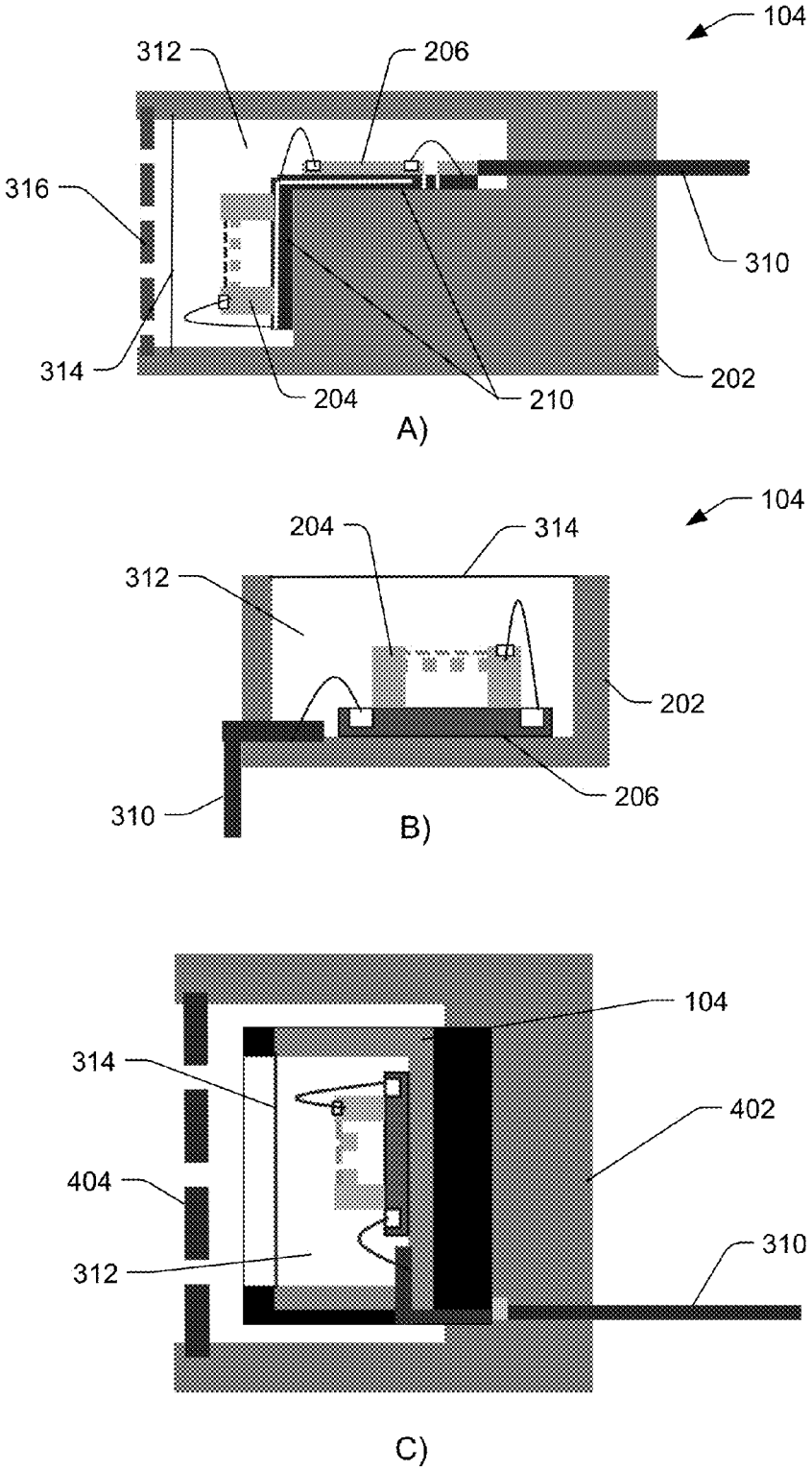
FIG. 4 shows cross-sectional profile views of three example housing arrangements including enclosed sensor arrangements, one example housing surrounded by a protective shell, according to various implementations.

Various implementations of a sensor 104, as described above are illustrated in FIGS. 4-7. Referring to FIG. 4, the sensor 104 at diagram A) is shown having an arrangement including a flexible carrier 210, such as a flexible bus, flex tape, or flexible PCB. As shown in the diagram at A) of FIG. 4, the sensor module 204 and control module 206 are enclosed within an over-molded package, both within the cavity 312. In alternate implementations, one or more portions of the sensor module 204 and/or the control module 206 may be encased within the package 202.

In another implementation, illustrated at diagram B) of FIG. 4, the sensor 104 includes a compact form factor, including a compact package 202. In an implementation, the package 202 comprises a molded package 202 including a cavity 312 and conductor leads 310 molded through the package 202.

As shown in the illustration of diagram B) of FIG. 4, the sensor 104 may not include a carrier 210. In an alternate implementation, the sensor 104 may include a bus or circuit tape, or other minimal circuit component in place of a carrier 210. In the illustrated implementation, the sensor module 204 is stacked upon the control module 206 to provide the compact form factor. Different mounting configurations for these or additional component(s) may be possible with different implementations.

In a further implementation, as shown at diagram C) of FIG. 4, the sensor 104 may be enclosed within a protective shell 402. For example, the shell 402 may be arranged to enclose the housing (i.e., package 202) and shield the package 202, the sensor module 204, and the control module 206 from environmental conditions. Thus, the shell 402 can provide protection for the sensor 104 against elements and outside forces while allowing access to the sensor module 204 for acoustic waveforms.

As shown in diagram C) of FIG. 4, the shell 402 may include a channel arranged to allow a conductor 310 to exit the shell 402. In an implementation, the shell 402 includes a protective screen 404 overlaying an opening of the shell 402. In the implementation, the screen 404 is arranged to prevent particles from entering the opening of the shell 402 and/or damaging the membrane 314.

The illustration of diagram C) shows the compact form factor of diagram B) enclosed within the shell 402. However, any of the form factors of sensor 104 may be enclosed within a shell 402, in various implementations.

In various implementations, the shell 402 may have any shape and size appropriate for the application. The shell 402 may be mounted to a location within the application system (e.g., vehicle, machine, process device, etc.) where the sensor 104 is needed to collect sensory information. In an alternate implementation, the package 202 may be mounted or located within the application system without a shell 402.

Figure 5:
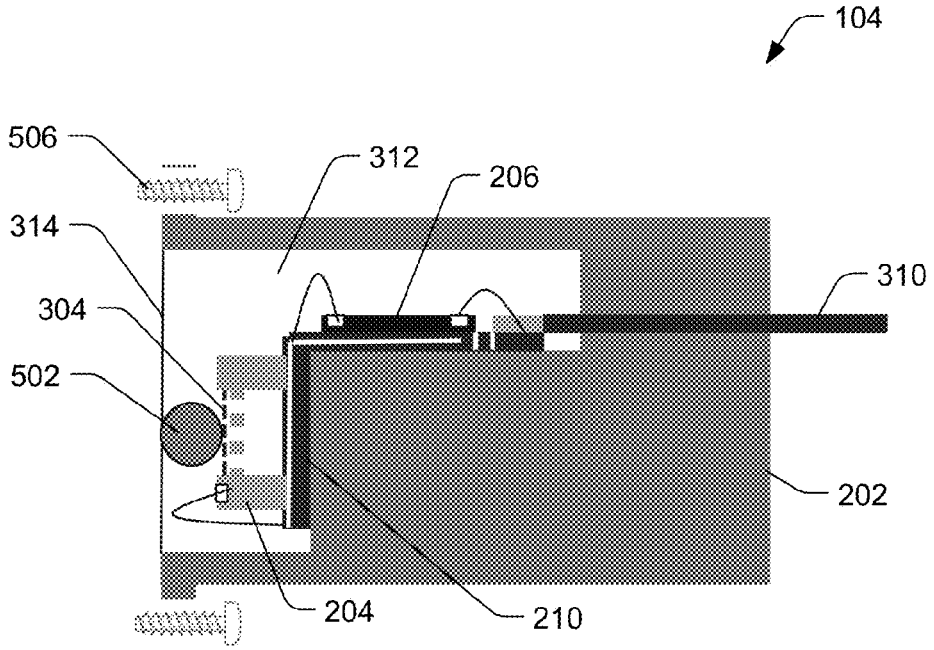
FIG. 5 shows cross-sectional profile views of two example housings including enclosed sensor arrangements, and further including enclosed transducer devices, according to the two implementations.
Figure 5:
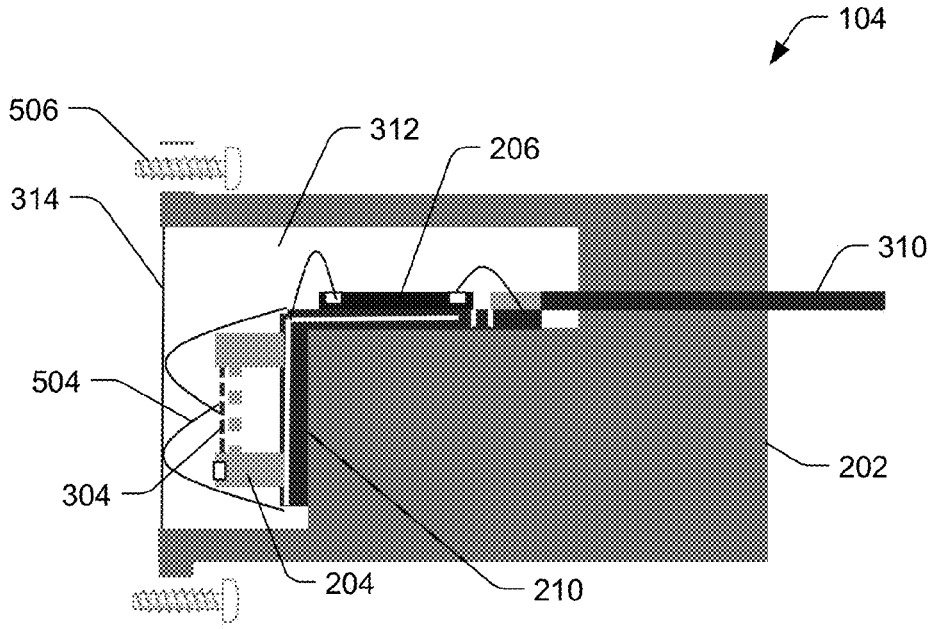

Referring to FIG. 5, two example implementations are illustrated showing a sensor 104 including a transducer component (502, 504). In various implementations, the sensor 104 may include a transducer component (502, 504) instead of having acoustical transducing media within the cavity 312 or in addition to having acoustical transducing media within the cavity 312.

As shown in FIG. 5, at both diagrams A) and B), the sensor 104 may include a membrane 314. In some implementations, the sensor 104 may include an object (i.e., the transducer component (502, 504)) within the cavity 312, making contact with the membrane 314 and one or more surfaces of the sensor module 204, such as the protective grid or membrane 304 of the sensor module 204. In this arrangement, the transducer component (502, 504) can conduct an acoustic waveform from the membrane 314 to the sensor module 204 at a rate based on the material and the configuration of the transducer component (502, 504).

For example, in diagram A) of FIG. 5, the transducer component 502 is shown as a spherical object. In various implementations the component 502 may be comprised of a polymer, a carbon-based material, a metallic material, a crystal, a glass, a silicon material, and so forth. The shape of the component 502, as well as the composition of the component 502 determines the rate and efficiency of the component 502 in conducting acoustic waveforms to the sensor module 204. In various alternate implementations, the component 502 may have other shapes as desired (e.g., polyhedral, elliptical, conical, etc.), including combinations of shapes and irregular forms.

In the example shown in diagram B) of FIG. 5, the transducer component 504 is shown as a spring-like object. In the implementation shown, the transducer component 504 comprises a spring component within the cavity 312, the spring component contacting a surface of the acoustic sensor (i.e., the sensor module 204) and arranged to conduct acoustic waveforms to the acoustic sensor. As described above, the shape of the component 504, as well as the composition of the component 504 determines the rate and efficiency of the component 504 in conducting acoustic waveforms to the sensor module 204. In various alternate implementations, the component 504 may have various shapes and dimensions as desired and be composed of a variety of materials (metallic materials, carbon-based materials, polymer-based materials, and so forth).

Also shown in the diagrams of FIG. 5 are fasteners 506 coupled to the sensors 104. In an implementation, a sensor 104 is arranged to be mounted to a surface or fixture using the fasteners 506, as discussed further below. The fasteners may be coupled to one location or multiple locations on the package 202 such that the sensor may be securely mounted. In various implementations, a variety of types of fasteners may be employed for this purpose (e.g., screws, rivets, nails, pins, connectors, cables, adhesives, welds, and so forth.

Figure 6:
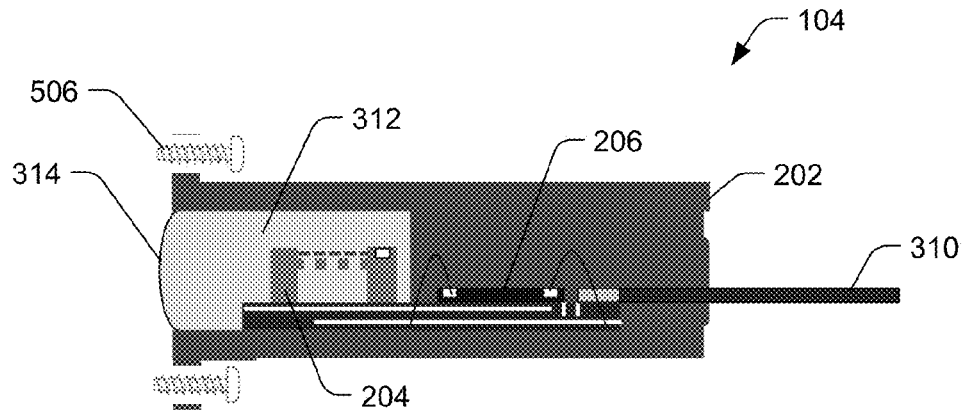
FIG. 6 is a cross-sectional profile view of an example housing including an enclosed sensor arrangement, and a view of the example housing as installed in an example application, according to an implementation.
Figure 6:
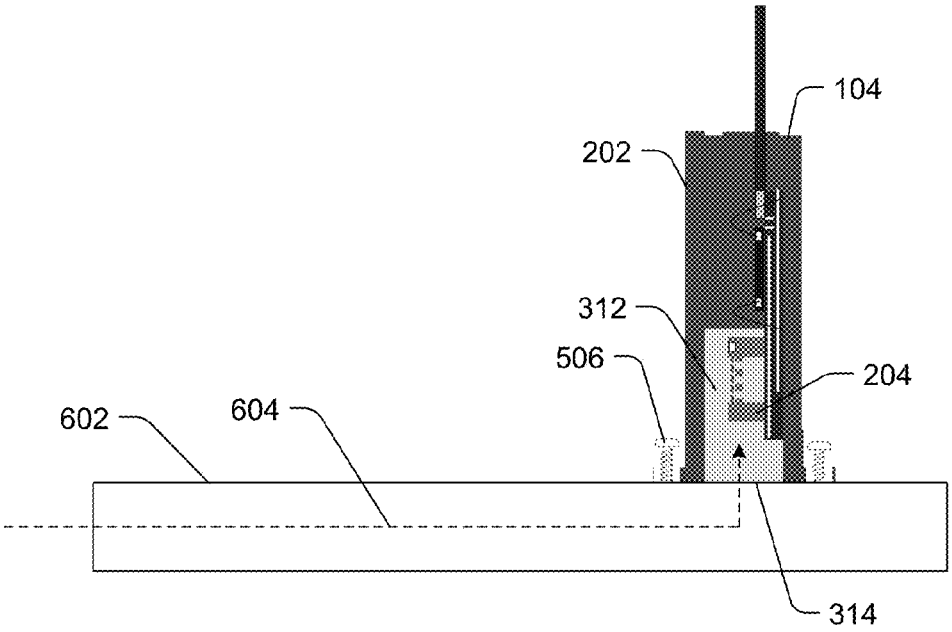
Figure 7:
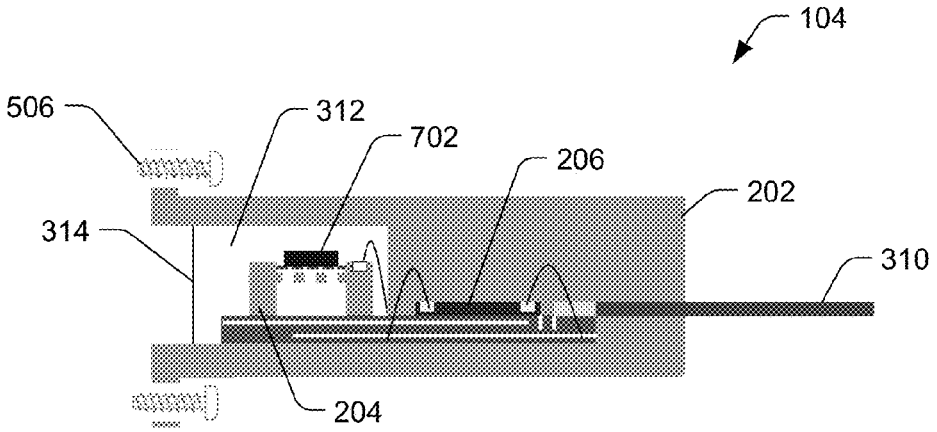
FIG. 7 is a cross-sectional profile view of an example housing including an enclosed sensor arrangement, and a view of the example housing as installed in an example application, according to another implementation.
Figure 7:
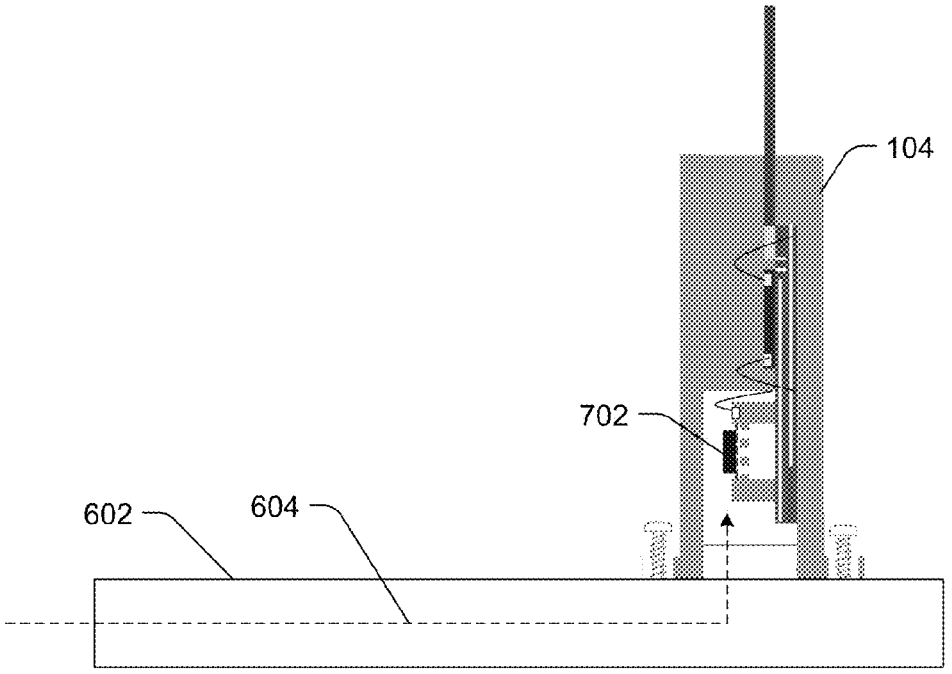

Referring to FIGS. 6 and 7, the illustrations at diagrams A) show a sensor 104 including a membrane 314 covering a cavity 312, as described above. In various implementations, the cavity 312 is partly or fully filled with an acoustic transducing medium. In various implementations, as shown in FIGS. 6 and 7, a sensor 104 is arranged to be fastened to a surface 602 (or like fixture), to promote conduction of acoustic waveforms 604 through the surface 602, thereby reducing a time for the sensor module 204 to receive the acoustic waveform 604.

For example, in one implementation, the package 202 includes one or more fasteners 506 protruding from the package 202 and arranged to couple the package 202 to the surface 602. In various implementations, the package 202 is arranged to be coupled to the surface 602 such that the opening of the cavity 312 faces the surface 602.

In an implementation, as shown in diagrams A) and B) of FIGS. 6 and 7, the package 202 is arranged to be coupled to a rigid surface 602 such that the membrane 314 is parallel to the rigid surface 602. In a further implementation, as shown in FIG. 6, the membrane is in contact with the rigid surface 602. In the implementations, the package 202 is coupled to the surface 602 such that acoustical waveforms 604 are transmitted from the rigid surface 602 to the membrane 314 and to the microphone (i.e., sensor module) 204, via transducing media within the cavity 312. In the implementations, the time for the sensor module 204 to receive the acoustical waveform may be reduced, based on the conduction path through the rigid surface 602 provided for the acoustical waveform. In various implementations, the rigid surface 602 may comprise a vehicle door, the vehicle frame, a portion of the vehicle body, a portion of a production line infrastructure, and so forth.

In an implementation, as shown in FIG. 7, the sensor 104 may include a seismic mass 702 coupled to the grid or membrane 304 of the sensor module 204. In the implementation, the seismic mass 702 acts as a solid transducer, conducting acoustic waveforms 604 to the grid or membrane 304 of the sensor module 204. In various implementations, the seismic mass 702 may be in addition to any of the other transducer-type components discussed above, singularly or in various combinations.

In one implementation, the acoustic waveform 604 is conducted from the rigid surface 602 to the sensor module 204 via the package 202. In an example, the package 202 swings around the seismic mass 702 based on the waveform 604, which transfers the acoustic waveform 604 to the grid or membrane 304 of the sensor module 204 based on inertial transfer from the package 202 to the seismic mass 702.

The techniques, components, and devices described herein with respect to the sensor 104 are not limited to the illustrations of FIGS. 1-7, and may be applied to other designs, types, and constructions of sensors or other electrical components without departing from the scope of the disclosure. In some cases, alternative components may be used to implement the techniques described herein.

Representative Process

Figure 8:
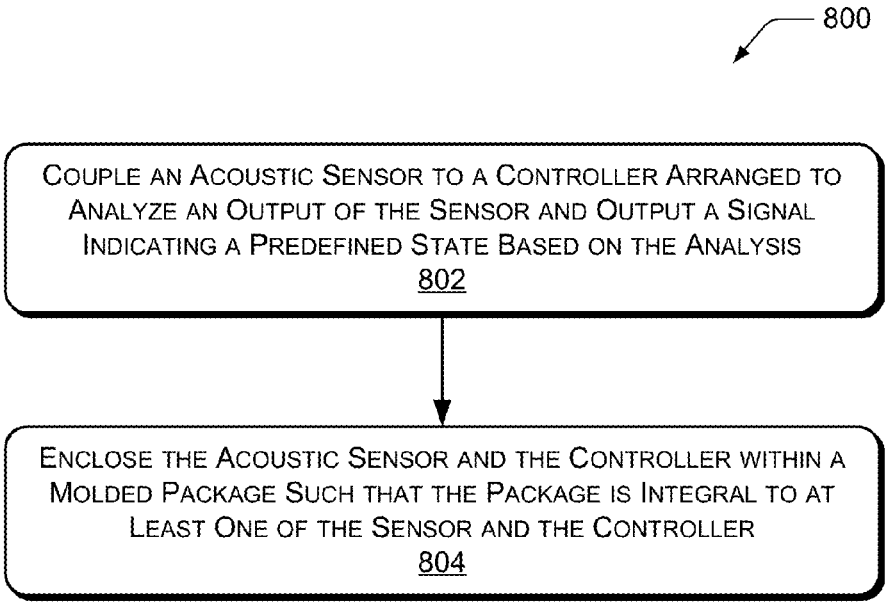
FIG. 8 is a flow diagram illustrating an example process for improving the signal receive time of a sensor, including enclosing the sensor within a housing, according to an implementation.

FIG. 8 illustrates a representative process 800 for improving the reception time of an acoustic waveform by a sensor component (such as sensor module 204, for example) within a package (such as package 202, for example), according to various implementations. In some implementations, the package may have a cavity (such as cavity 312, for example) where the sensor component is mounted. The process 800 is described with reference to FIGS. 1-7.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable materials, or combinations thereof, without departing from the scope of the subject matter described herein.

At block 802, the process 800 includes coupling an acoustic sensor (such as sensor module 204, for example) to a controller (such as control module 206, for example). The controller is arranged to analyze an output of the acoustic sensor and to output a signal indicating a predefined state based on the analysis. In alternate implementations, the process includes coupling another type of sensor (e.g., pressure sensor, acceleration sensor, gravity sensor, etc.) to the controller. In an implementation, the controller triggers the deployment of a safety device or restraint device based on the output signal.

In an example implementation, the acoustic sensor comprises a microphone, such as a miniature surface-mount microphone, or similar device. In another example, the controller comprises an application specific integrated circuit (ASIC), a processor, a logic circuit, or the like.

At block 804, the process includes enclosing the acoustic sensor and the controller within a molded package (such as package 202, for example) such that the molded package is integral to at least one of the acoustic sensor and the controller. In various implementations, additional devices, circuits, and the like, may be housed within the cavity of the package.

In an implementation, the process includes coupling at least one of the acoustic sensor and the controller to a carrier (such as carrier 210, for example). In a further implementation, the package is molded to at least a portion of the carrier. In an implementation, the carrier comprises one or more of a bus, a printed circuit board (PCB), a flexible printed circuit carrier, a circuit tape, and the like.

In an implementation, the process includes enclosing at least one of the acoustic sensor and the controller within a cavity (such as cavity 312, for example) of the molded package. In one implementation, the process includes at least partially filling the cavity with an acoustically transducing material and sealing the cavity with an acoustically transparent membrane (such as membrane 314, for example).

In an implementation, the process includes mounting the package to a rigid surface (such as surface 602, for example) such that the membrane is parallel to and in contact with the rigid surface. For example, the package is mounted to the surface such that acoustical waveforms (such as waveforms 604, for example) are transmitted from the rigid surface to the membrane and to the acoustic sensor, via the transducing material.

In an implementation, the process includes mounting the package to the rigid surface such that the cavity of the package faces the rigid surface. In a further implementation, the package is mounted to the rigid surface such that acoustical waveforms are transferred (e.g., conducted, etc.) to the acoustic sensor via the package.

In one implementation, the process includes enclosing the package within a rigid shell (such as shell 402, for example) and covering an opening of the shell with a protective screen (such as screen 404, for example). In the implementation, the shell and screen are arranged to protect the acoustical sensor from harsh environmental factors, such as particles, humidity, and so forth.

In alternate implementations, other techniques may be included in the process 800 in various combinations, and remain within the scope of the disclosure.

Conclusion

Although the implementations of the disclosure have been described in language specific to structural features and/or methodological acts, it is to be understood that the implementations are not necessarily limited to the specific features or acts described. Rather, the specific features and acts are disclosed as representative forms of implementing example devices and techniques.

What is claimed is:

1. An apparatus, comprising: an acoustic sensor;

a controller arranged to analyze an output of the acoustic sensor and to output a signal indicating a predefined state based on the analysis;

a molded package enclosing and integral to the acoustic sensor and the controller, the package including a cavity surrounding at least the acoustic sensor; and a transducer component within the cavity, the transducer component contacting a protective membrane of the acoustic sensor and conducting acoustic waveforms from the membrane to the acoustic sensor.

2. The apparatus of claim 1, further comprising a memory storage device coupled to the controller and including at least one of calibration data and reference data stored thereon.

3. The apparatus of claim 1, wherein the transducer component comprises a metallic or polymer-based object.

4. The apparatus of claim 1, wherein the transducer component comprises a spring component within the cavity, the spring component contacting a surface of the acoustic sensor and arranged to conduct acoustic waveforms to the acoustic sensor.

5. The apparatus of claim 1, further comprising a protective screen overlaying an opening of the package, the screen arranged to prevent particles from entering the cavity.

6. The apparatus of claim 1, wherein the protective membrane overlays an opening of the package, the membrane arranged to seal the opening of the package and to allow acoustic waveforms to pass into the cavity to the acoustic sensor.

7. A system, comprising:

a sensor module arranged to receive an acoustic waveform and to output a signal based on the waveform;

a control module arranged to receive the signal output from the sensor module and to output a state signal indicating one of a plurality of predefined states based on the signal output from the sensor module; and a housing comprising a molded package enclosing the sensor module and the control module and including a cavity surrounding at least the sensor module, the cavity at least partly filled with an acoustical transducing medium.

8. The system of claim 7, further comprising an output module arranged to transmit the state signal.

9. The system of claim 8, wherein the output module includes a wireless transmitter arranged to transmit the state signal via one or more wireless technologies.

10. The system of claim 7, further comprising a carrier enclosed within the housing and arranged to provide one or more signal paths for the sensor module and/or the control module, the sensor module and/or the control module coupled to the carrier.

11. The system of claim 10, wherein the housing is molded to the carrier.

12. The system of claim 10, wherein the carrier comprises a flexible bus or a flexible printed circuit board (PCB).

13. The system of claim 7, further comprising a shell enclosing the housing and shielding the housing, the sensor module, and the control module from environmental conditions.

14. The system of claim 13, the shell including a protective screen overlaying an opening of the shell, the screen arranged to prevent particles from entering the opening of the shell.

15. The system of claim 7, wherein the acoustical transducing medium comprises one of a gas, a liquid, a solid medium, or a combination of the same.

16. A method, comprising:

coupling an acoustic sensor to a controller arranged to analyze an output of the acoustic sensor and to output a signal indicating a predefined state based on the analysis;

enclosing the acoustic sensor and the controller within a molded package such that the molded package is integral to at least one of the acoustic sensor and the controller;

enclosing at least one of the acoustic sensor and the controller within a cavity of the molded package; and at least partially filling the cavity with an acoustically transducing material being a liquid and/or solid material and sealing the cavity with an acoustically transparent membrane.

17. The method of claim 16, further comprising coupling at least one of the acoustic sensor and the controller to a carrier and molding the package to at least a portion of the carrier, the carrier comprising at least one of a bus, a printed circuit board (PCB), and a flexible printed circuit carrier.

18. The method of claim 16, further comprising mounting the package to a rigid surface such that the membrane is parallel to and in contact with the rigid surface, and such that acoustical waveforms are transmitted from the rigid surface to the membrane and to the acoustic sensor, via the transducing material.

19. The method of claim 16, further comprising enclosing the package within a rigid shell and covering an opening of the shell with a protective screen.

20. A system, comprising:

a microphone arranged to receive an acoustic waveform and to output a signal based on the waveform;

a microcontroller arranged to analyze the signal output from the microphone and to output a state signal indicating one of a plurality of predefined states based on analyzing the signal output from the microphone; and a molded package integral to and enclosing the microphone and the microcontroller and including a sealed cavity surrounding at least the microphone, the sealed cavity at least partly filled with acoustical transducing media including one or more of, a liquid, and a solid medium, and sealed with an acoustically transparent membrane.

21. The system of claim 20, wherein the molded package is arranged to be coupled to a rigid surface such that the membrane is parallel to and in contact with the rigid surface, and such that acoustical waveforms are transmitted from the rigid surface to the membrane and to the microphone, via the transducing media.

22. The system of claim 7, further comprising a seismic mass coupled to a membrane of the sensor module.

23. The system of claim 12, wherein the flexible bus or PCB is disposed on a plurality of perpendicular surfaces of the molded package.

* * * * *